US005360029A

United States Patent [19]

Goughneour

[11] Patent Number: 5,360,029

[45] Date of Patent: Nov. 1, 1994

[54] VACUUM BREAKER

[75] Inventor: Richard J. Goughneour, Travelers Rest, S.C.

[73] Assignee: T & S Brass and Bronze Works, Inc., Travelers Rest, S.C.

[21] Appl. No.: 78,401

[22] Filed: Jun. 17, 1993

[51] Int. Cl.[5] ..... E03C 1/10

[52] U.S. Cl. ..... 137/218; 137/217

[58] Field of Search ..... 137/217, 218

[56] References Cited

U.S. PATENT DOCUMENTS

| | | | |
|---|---|---|---|
| 2,028,101 | 1/1936 | Frederickson | 137/217 |
| 2,209,189 | 7/1940 | Callejo | 137/218 |
| 2,303,037 | 11/1942 | Frederickson | 137/218 |
| 2,512,478 | 6/1950 | Callejo | 137/217 |
| 2,512,479 | 6/1950 | Callejo | 137/217 |
| 2,627,278 | 2/1953 | Somers | 137/218 |
| 3,189,037 | 6/1965 | Callejo | 137/218 |
| 3,414,003 | 12/1968 | Wyckoff | 137/217 |
| 4,592,382 | 6/1986 | Rubin et al. | 137/218 |

*Primary Examiner*—Gerald A. Michalsky

*Attorney, Agent, or Firm*—Dority & Manning

[57] ABSTRACT

A vacuum breaker is provided comprising a body member having an inlet and an outlet defined therein. A core insert member may be threadedly engaged within the body member having a chamber defined therein. A vent passage is defined within the body member to vent the outlet side of the device to atmosphere. A piston member is movably disposed within the chamber between an upper limit stop and a lower limit stop so as to variably restrict liquid passage through the device. At its lower limit stop, the piston essentially seals the inlet from the outlet while the vent passage vents the outlet to atmosphere. At its upper limit stop, the piston essentially seals the vent passage from the outlet. A drain passage is defined within the device generally between near the top portion of the chamber and the outlet so that liquid entrapped within the chamber above the piston member drains through this drain passage to the outlet side of the device during movement of the piston within the chamber. In this manner, liquid entrapped above the piston member is prevented from being pumped out of the device during movement of the piston.

7 Claims, 2 Drawing Sheets

VACUUM BREAKER

BACKGROUND OF THE INVENTION

The present invention relates to an anti-siphoning device for use in plumbing systems, and more particularly to an improved vacuum breaker.

The use and theory of vacuum breakers in plumbing systems is well known in the art. Essentially, the vacuum breaker allows an outlet or downstream side of the device to be vented to atmosphere to allow proper drainage thereof while preventing contamination of the upstream or inlet side due to siphoning of downstream liquid. Conventional vacuum breakers utilize a movable piston-like member movably disposed within a flow chamber of the device. As commonly understood, inlet flow pressure causes the piston to move upwards within the flow chamber thereby allowing the liquid to flow to the outlet side of the device. The outlet side is vented to allow proper drainage downstream of the outlet. At relatively high inlet pressures, the piston-like member essentially seals the outlet side of the device from the vent to prevent liquid passing directly from the inlet to the vent. With no inlet flow, the piston-like member seals the inlet side from the outlet while the outlet remains vented.

However, a substantial problem with conventional vacuum breakers is that during a condition of relatively low system inlet pressure, for example approximately 8 PSI and below, conventional vacuum breakers will leak due to "pumping" action of the piston within the flow chamber. During this low pressure flow, the water pressure forces the piston to rise within the flow chamber thereby allowing water to discharge through the outlet. However, the inlet flow pressure is not sufficient enough to move the piston within the chamber so as to seal the outlet from the vent. As the outlet volume of fluid increases due to, for example, restrictions in the outlet port or downstream backup, liquid tends to accumulate or flow back on top of the piston within the flow chamber. Subsequently, this water above the piston within is pumped out through the vent opening upon subsequent movement of the piston within the flow chamber. This leaking phenomena of conventional vacuum breakers is widely recognized in the industry as an unsatisfactory condition. With the present invention, applicant has substantially eliminated the leakage of vacuum breakers at relatively low system pressure flow.

OBJECTS AND SUMMARY OF THE INVENTION

It is a principle object of the present invention to provide an improved vacuum breaker which substantially eliminates leakage from the device at relatively low inlet system pressures.

It is a further object of the present invention to provide an anti-siphoning device which can be readily assembled and disassembled for maintenance and replacement of parts.

Still a further object of the present invention is to provide a vacuum breaker for use in any conventional system without modification to the systems.

It is also an object of the present invention to provide an improved vacuum breaker that substantially eliminates leakage regardless of the inlet system pressure.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein the vacuum breaker according to the invention comprises a body member which has an inlet and an outlet defined therein. A chamber is also defined within the body member. The chamber defines a liquid passage through the body from the inlet to the outlet. A vent passage is defined in the body member and defines a vent path from the outlet to atmosphere. In a preferred embodiment, the vent passage is defined from generally atop the chamber through the body member. In this manner, the outlet is vented to atmosphere through a portion of the chamber. Alternatively, the vent passage could be separate from the chamber. A piston member is movably disposed within the chamber between an upper limit stop and a lower limit stop. The piston member variably restricts liquid passage from the inlet through the chamber and into the outlet. The piston is moved within the chamber by inlet system pressure. When the piston is at the lower limit stop, it essentially seals the inlet from the outlet while the vent passages vents the outlet to atmosphere. When the piston is at the upper limit stop, it essentially seals the vent passage from the outlet. The vacuum breaker further comprises a drain passage defined between generally the top portion of the chamber and the outlet so that any liquid entrapped within the chamber above the piston drains through the drain passage to the outlet during movement of the piston within the chamber. In this manner, the entrapped liquid is not pumped out through the vent opening as with conventional vacuum breakers. During relatively high inlet system pressure, it is preferred that the piston member also seal the drain passage from the outlet so as to prevent backflow of outlet liquid through the drain passage to the vent opening. In one embodiment of the invention, the drain passage is defined within the chamber just below the upper limit stop so that the piston member will seal the drain passage at high inlet system pressure. In an alternative embodiment, however, the drain passage may be defined generally above the chamber, for example, within the actual vent passage.

In an alternative preferred embodiment of the invention, the vacuum breaker further comprises a core insert member which is removably fitted into the body member, preferably by being threadedly engaged therewith. The core insert member defines the chamber therein and further comprises an inlet opening and an outlet opening. The inlet and outlet openings are in fluid communication with the body member inlet and outlet respectively when the core insert member is fitted into the body member. The core insert member further includes a vent hole defined therein which is matable with the vent passage of the body member. In one embodiment, the vent hole may comprise substantially the entire length of the vent passage within the body. The core insert member also comprises at least one drainage slit, and preferably two such slits, defined therethrough generally near the top of the chamber and in communication with the drain passage within the body member. Again, the drainage slits may be defined generally into the chamber near the top thereof or above the chamber within the vent hole.

In a preferred embodiment of the invention, the drainage passage comprises a space defined between the body member and the core insert member. The drain slits of the core insert member open into the drain passage. The drain passage is, in turn, in liquid communication with the outlet of the body member. Thus, the space or drain passage essentially surrounds the outer circumferential surface of the core insert member. The drain slit may comprise a single slit or a series of slits within the core member which are in liquid communication with the drain passage or circumferential space.

And in still a further preferred embodiment of the invention, when the piston member is at the upper limit stop it essentially seals the drainage passage so that during a condition of relatively high inlet pressure flow through the vacuum breaker, back flow of liquid from the outlet side of the device through the drainage passage is prevented.

In further accordance with the objects of the invention, an improved anti-siphoning device is provided of the type having a movable piston-like member disposed within a flow chamber generally intermediate an inlet and an outlet wherein the outlet is vented to atmosphere through a vent defined in the device. The device allows drainage of liquid downstream of the outlet while preventing siphonage of the downstream liquid to the inlet side of the device. The anti-siphoning device according to the invention further comprises a drain passage defined in the device from generally near the top of the flow chamber to the outlet so that any liquid entrapped within the flow chamber above the piston-like member drains through the passage to the outlet and thereby prevents leakage of the liquid from the device through the vent. Preferably, the drain passage comprises at least one opening defined generally just below the upper boundary of the flow chamber. In this manner, during a condition of relatively high inlet pressure flow through the device, the piston-like member is forced upwards to its upper limit within the flow chamber and seals the drain passage thereby preventing backflow from the outlet side of the device through the drain passage and into the vent.

The accompanying drawings, which are incorporated in and constitute a part of the specification, illustrate embodiments of the invention and, together with the description, serve to explain the principles of the invention.

DESCRIPTION OF THE PREFERRED EMBODIMENTS

Reference will now be made in detail to the present preferred embodiments of the invention, examples of which are illustrated in the accompanying drawings.

Figure 1:
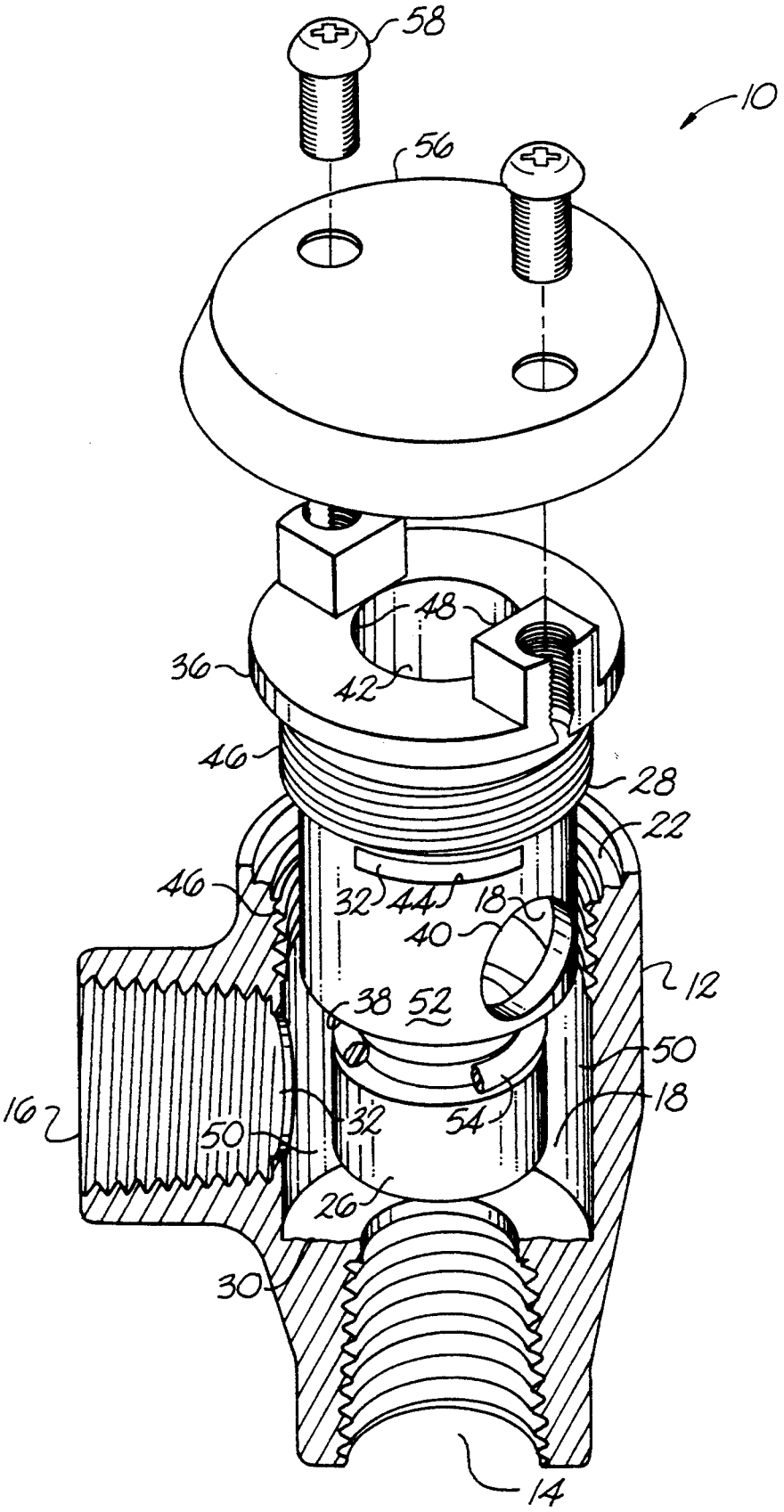
FIG. 1 is a perspective component view of a preferred embodiment of the present invention with certain components represented in cut-away view.

Referring to FIG. 1 in general, an anti-siphoning device or vacuum breaker 10 is provided. Vacuum breaker 10 includes a body member 12 having an inlet 14 and an outlet 16 defined therein. Body member 12 may be formed of any suitable conventional material, such as stainless steel, brass, or the like. Also, inlet 14 and outlet 16 are agreeably threaded, as illustrated in the figure, so as to be mated with other pipes, fixtures, etc. Additionally, the orientation of inlet 14 and outlet 16 illustrated in FIG. 1 is but a mere preferred arrangement wherein the axis of the inlet and outlet are substantially perpendicular. It is further possible to have the inlet axis off-set from and substantially parallel to the outlet axis. For example, inlet 14 could be disposed on the right hand side of body member 12 substantially above or below outlet 16.

Vacuum breaker 10 further comprises a chamber 18 defined therein. The chamber defines a liquid passage through body member 12 from inlet 14 through outlet 16. In this sense, chamber 18 may be considered as intermediate inlet 14 and outlet 16. Fluid flow through the device is through inlet 14, through chamber 18, and exits through outlet 16.

As illustrated in the figures, chamber 18 is substantially circular in configuration, but this is not meant as a limitation. Chamber 18 could comprise any suitable geometric shape.

A vent passage 22 is also defined within body member 12. The vent passage defines a vent path from outlet 16 to atmosphere. In the embodiment illustrated in FIG. 1, vent passage 22 vents outlet 16 through chamber 18. In other words, the vent path from the outlet side of the device is from outlet 16, through chamber 18, and out vent path 22. In this embodiment, vent path 22 essentially exposes or opens at least a portion of chamber 18 to atmosphere. In an alternative embodiment, vent passage 22 may be defined within body member 12 so as not to expose the top portion of chamber 18 to atmosphere. For example, vent passage 22 may be defined within the threaded portion of outlet 16.

Vacuum breaker 10 further comprises a piston member 26 which is movably disposed within chamber 18 between an upper limit stop 28 and a lower limit stop 30. Piston member 26 variably restricts fluid flow between inlet 14 and outlet 16 by its movement within passage 18. For example, when piston member 26 is at its upper limit stop, there is full fluid flow from the inlet to the outlet of the vacuum breaker. As is understood in the art, piston member 26 is displaced or moved within chamber 18 in response to inlet fluid pressure. As inlet fluid pressure increases, piston member 26 rises within chamber 18. Upper limit stop 28 and lower limit stop 30 may be integrally formed within body member 12, or, as will be discussed, may comprise components of a core insert member 36 which is inserted into body member 12. The upper and lower limit stops define the range of movement of piston member 26 within chamber 18.

A drain passage 32 is defined between generally near the top portion of chamber 18 and outlet 16. In this manner, liquid that becomes entrapped within chamber 18 above piston member 26 will drain through the drain passage to the outlet during movement of the piston within the chamber. As is understood in the art, with conventional vacuum breakers, downstream backup or restrictions with relatively low inlet system pressures tends to cause downstream liquid to flow back into chamber 18 above movable piston 26. Subsequently, when the inlet system pressure increases movable piston 26 moves upward within chamber 18 and has the tendency to pump any liquid entrapped thereabove out the vacuum breaker through the vent. Drain passage 32 is provided in the present invention to define a drainage path for the liquid entrapped above piston member 26 to flow from above the piston into the outlet 16 before being pumped out through the vent opening.

Referring to the figures in general, in a preferred embodiment of vacuum breaker 10, a core insert member 36 is provided. Core insert member 36 is removably fitted into body member 12, for instance, through threaded engagement therewith. In this manner, threads 46 are provided on core member 36 and within body member 12 as particularly illustrated in FIG. 1. Core insert member 36 comprises an inlet opening 38 and an outlet opening 40 which are matable with inlets 14 and 16 of body member 12 respectively. Also, core member 36 includes chamber 18 defined therein. Thus, when core insert member 36 is engaged within body member 12, the liquid passage through the device is through inlet 14, through inlet opening 38, through chamber 18 defined within core insert member 36, through outlet opening 40, and exiting through outlet 16 of body member 12. Core insert member 36 is preferably formed of a durable wear-resistant plastic material, or any other suitable material. In this embodiment, piston member 26 is sized so as to slide within core insert member 36. An O-ring or other sealing member 54 is preferably disposed around piston member 26 generally at the top thereof. Additionally, core insert member 36 includes a vent hole 42 defined therein. In the embodiment illustrated, vent hole 42 is defined through the top of core insert member 36 and is in communication with chamber 18. In a preferred embodiment, radius 48 of vent hole 42 is smaller or less than the radius of chamber 18. In this manner, the lower end of vent hole 42 defines upper limit stop 28 for piston member 26. Lower limit stop 30 is defined by a seating surface defined within body member 12. This embodiment is also preferred in that it allows for easy access and removal of the components of the invention. For example, core insert member 36 can be unscrewed from body member 12 for replacement or maintenance thereof. Additionally, piston member 26 can be removed once core insert member 36 is removed from body member 12. Thus, the invention affords easy maintenance and low cost replacement of essential components.

Core insert member 36 also preferably comprises at least one drainage slit 44 defined therethrough. In a preferred embodiment, a series of such slits are defined through the member generally around the outer circumference thereof and comprise a portion of drain passage 32. In this embodiment, liquid entrapped above piston member 26 flows out slits 44 into a space 50 defined between core insert member 26 and body member 12. Space 50 is also thus a portion of drain passage 32. It should be understood, however, that there is any number of arrangements of drain passage 32. For example, drain passage 32 may comprise a passage defined within body member 12 directly from slit or opening 44 into outlet portion 16. Any configuration or arrangement which allows fluid entrapped above the piston to be drained out of the chamber before being pumped out the vent opening by the piston member is within the scope and spirit of the invention.

Figure 2:
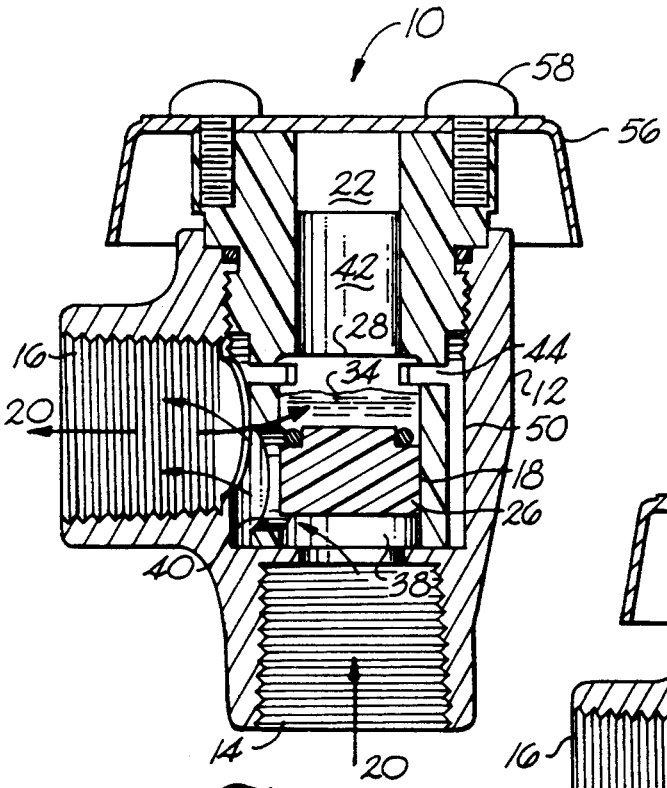
FIG. 2 is a perspective cut-away view of an embodiment of the present invention particularly illustrating the internal arrangement of components.
Figure 3:
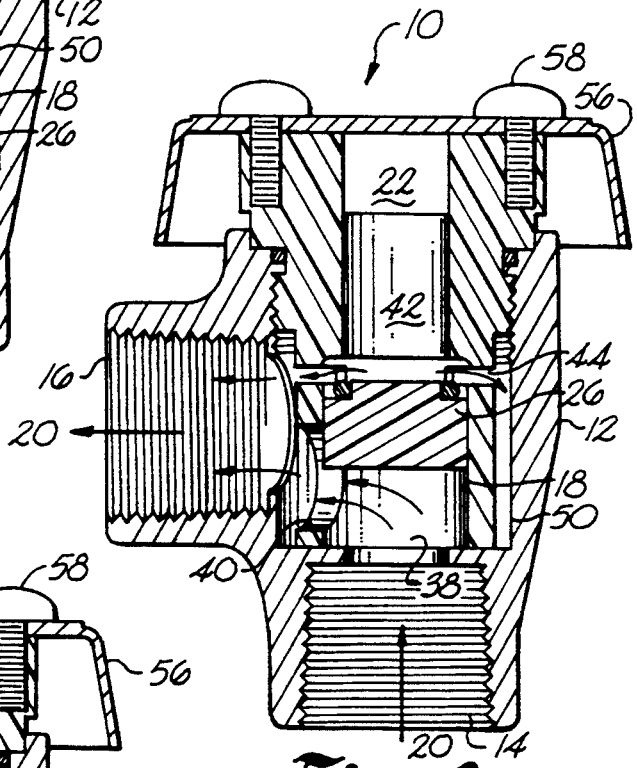
FIG. 3 is a perspective cut-away view of the invention illustrated in FIG. 2 particularly illustrating operation of the drain passage through the flow chamber.
Figure 4:
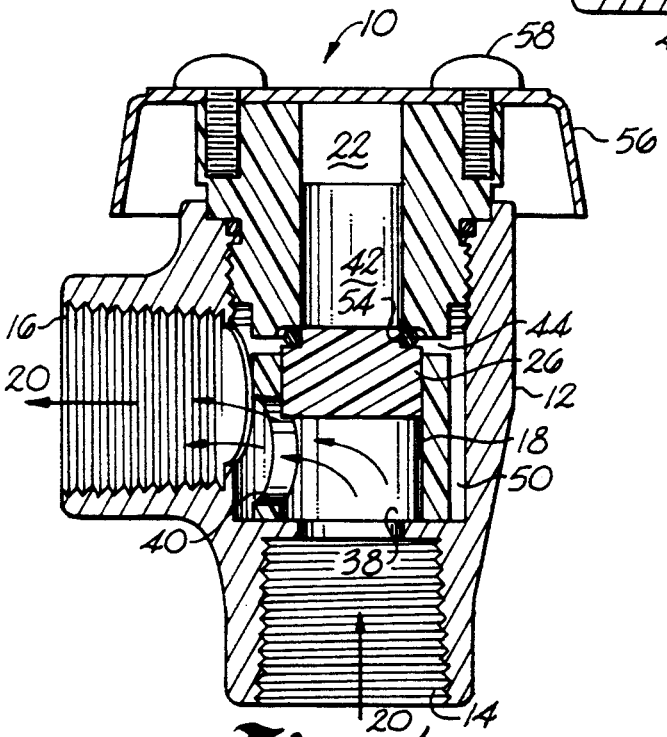
FIG. 4 is a perspective cut-away view of the embodiments of FIGS. 2 and 3 particularly illustrating the piston member within the flow chamber at the upper limit thereof.

Referring particularly to FIGS. 2 through 4, operation of the present invention will now be explained. FIG. 2 illustrates the present vacuum breaker 10 in operation with a liquid passage 20 being defined by inlet 14, chamber 18, and out outlet 16. FIG. 2 illustrates the device in operation with a relatively low inlet system pressure, for example approximately 8 PSI and below. As can be seen in the figure, the inlet system pressure is not sufficient enough to lift piston member 26 to upper stop limit 28 which, in this embodiment, is the beginning of vent hole 42 defined in core insert member 36. Thus, due to downstream impedance or backup, some of the liquid flowing through the device will enter the space within chamber 18 above piston member 26 by backflowing through outlet opening 40. This liquid is identified as 34 in FIG. 2.

FIG. 3 illustrates the embodiment of FIG. 2 at a relatively higher inlet system pressure. In this embodiment, it is clearly seen that the inlet system pressure has lifted piston member 26 to a height so that liquid 34 is now discharged from chamber 18 through slits 44. The liquid enters space 50 between core insert member 36 and body member 12 and eventually drains through outlet 16. In this manner, the liquid is prevented from being pumped out through vent hole 42 and vent passage 22. FIG. 4 illustrates the device at a system inlet pressure wherein piston member 26 is forced to its upper limit stop within core insert member 36. As is clearly seen in the figure, piston member 26 is forced against its upper limit stop with O-ring 54 sealing slits 44. In this manner, backflow through slits 44 into vent opening 42 is prevented at high system pressures and vent opening 16 and the system downstream thereof is not vented to atmosphere during such a relatively high inlet system pressure flow. Once the inlet system pressure decreases, piston member 26 will lower within chamber 18 again venting downstream to atmosphere while sealing the inlet side of the device from the outlet side to prevent contamination of the inlet side. At relatively little or no inlet system pressure, piston member 26 would seat against lower limit stop 30 so that inlet 14 is completely sealed from outlet 16 which remains constantly vented to atmosphere.

The figures also illustrate the device 10 as comprising a cap 56 attached to the device through, for example, screws 58. Cap 56 serves to provide an aesthetically pleasing appearance to the device while preventing matter from entering vent opening 42.

It will be apparent to those skilled in the art that various modifications and variations can be made in the apparatus and method of the present invention without departing from the scope or spirit of the invention. For example, the figures illustrate but one preferred embodiment of a drain passage defined through an anti-siphoning device in accordance with the present invention. The drain passage can be defined in a countless number of ways to provide the same benefit of draining liquid entrapped above the piston member so as to prevent pumping of this liquid out of the device. Thus, it is intended that the present invention cover the modifications and variations of this invention provided they come within the scope of the appended claims and their equivalents.

What is claimed is:

1. A vacuum breaker, comprising:

a body member, said body member having an inlet and an outlet defined therein;

a chamber defined within said body member, said chamber defining a liquid passage through said body member from said inlet to said outlet;

a vent passage defined in said body member, said vent passage defining a vent path from said outlet to atmosphere;

a piston member movably disposed within said chamber between an upper limit stop and a lower limit stop so as to variably restrict said liquid passage, wherein at said lower limit stop said piston essentially seals said inlet from said outlet with said vent passage venting said outlet, and at said upper limit stop said piston essentially seals said vent passage from said outlet;

a core insert member fitted into said chamber, said piston member being movable within said core insert member, said core insert member defining an inlet opening mateable with said body inlet and an outlet opening mateable with said body outlet; and a drain passage separate from said outlet opening defined in said core insert member between said outlet opening and said upper limit stop, said drain passage defining a drain path for liquid entrapped within said chamber above said piston member to said outlet during movement of said piston within said chamber, wherein said piston member seals said drain passage from said vent passage when at said upper limit stop.

2. The vacuum breaker as in claim 1, wherein said core insert member is threadedly engaged within said body member.

3. The vacuum breaker as in claim 1, wherein said vent passage comprises a radius smaller than the radius of said chamber, the lower end of said vent passage thereby defining said upper limit stop.

4. The vacuum breaker as in claim 3, wherein said body member defines said lower limit stop, said piston member thereby being removable from said core insert member once said core insert member is removed from said body member.

5. The vacuum breaker as in claim 1, wherein the axis of said inlet and said outlet are substantially perpendicular, and wherein the axis of said chamber is parallel with the axis of said inlet.

6. The vacuum breaker as in claim 1, wherein said drain passage comprises at least one drainage slit defined in said core insert member in fluid communication with a space between said body member and the outer surface of said core insert member and in liquid communication with said outlet, said drainage slit opening to said space so that liquid entrapped above said piston within said core insert member drains through said slit to said space and into said outlet.

7. A vacuum breaker, comprising:

a body member having an inlet and an outlet defined therein;

a core insert member threadedly engaged within said body member, said core insert further comprising;

a chamber defined therein;

an inlet hole opening into said chamber and in fluid communication with said body member inlet;

an outlet hole exiting from said chamber and in fluid communication with said body member outlet, wherein a first liquid passage is defined from said body member inlet, through said inlet hole, through said outlet hole to said body member outlet;

a vent hole opening from the top of said chamber and venting said chamber to atmosphere;

at least one drain slit defined therethrough separate from and above said outlet hole; and a piston member movably disposed within said chamber and configured to seal said inlet hole from said outlet hole at the lower limit of its travel within said chamber and to seal said vent hole and said drain slit from said outlet hole at the upper limit of its travel within said chamber; and a drainage space defined between said body member and said core insert member, said drainage space being in liquid communication with said drain slit and said body member outlet and defining a drain passage separate from said first liquid passage for liquid entrapped within said chamber above said piston member from said drain slit to said drainage space and into said body member outlet thereby preventing the entrapped liquid from being forced out said vent hole by movement of said piston within said chamber.

* * * * *